US006253463B1

(12) United States Patent
Hansen

(10) Patent No.: US 6,253,463 B1
(45) Date of Patent: Jul. 3, 2001

(54) METHOD OF SPRAY DRYING

(75) Inventor: Ove Emil Hansen, Allerød (DK)

(73) Assignee: Niro A/S, Soborg (DK)

( * ) Notice: Subject to any disclaimer, the term of this patent is extended or adjusted under 35 U.S.C. 154(b) by 0 days.

(21) Appl. No.: 09/304,990

(22) Filed: May 4, 1999

(30) Foreign Application Priority Data

Apr. 26, 1999 (DK) ..... 1999 00570

(51) Int. Cl.[7] ..... F26B 3/08

(52) U.S. Cl. ..... 34/362; 34/366; 34/373; 34/405

(58) Field of Search ..... 34/362, 366, 372, 34/373, 405

(56) References Cited

U.S. PATENT DOCUMENTS 3,771,237 * 11/1973 Hansen et al. .
3,780,445 * 12/1973 Hansen .
3,828,837 * 8/1974 Damgaard-Iversen et al. ..... 159/4 R
4,229,249 * 10/1980 Felsvang et al. ..... 159/4 B
5,040,954 * 8/1991 Iwai ..... 417/423.12
5,076,920 * 12/1991 Danowski et al. ..... 210/243
5,248,387 * 9/1993 Hansen ..... 159/48.1
5,612,367 3/1997 Timko et al. .
5,632,100 * 5/1997 Hansen ..... 34/374
5,641,745 6/1997 Ramtoola .
5,647,142 * 7/1997 Andersen et al. ..... 34/373
5,785,032 * 7/1998 Yamashita et al. ..... 123/509

OTHER PUBLICATIONS

World Intellectual Property Org., WO98/57967, An Itraconazole Exhibiting an Improved Solubility, A Method of Preparing the Same and a Pharmaceutical Composition for Oral Administration Comprising the same, Dec. 23, 1998.

* cited by examiner

*Primary Examiner*—Pamela Wilson
(74) *Attorney, Agent, or Firm*—Sughrue, Mion, Zinn, Macpeak & Seas, PLLC

(57) ABSTRACT

Spray drying is performed at increased pressure whereby advantages are obtained as to product characteristics and production capacity. Particulate materials of an amorphous structure and non-dusting high-bulk density powders can be obtained.

13 Claims, 5 Drawing Sheets

METHOD OF SPRAY DRYING

FIELD OF THE INVENTION

The present invention relates to spray drying as applied within a broad range of industries, e.g. the pharmaceutical, chemical, dairy, food, ceramic and powder metallurgical industries.

More specifically, the invention deals with improvements in spray drying where an amorphous product is desired, as is often true in the pharmaceutical industry and/or where a high-bulk density of the resulting powder is desired and/or where increase of the production capacity of a spray drying device is desired.

BACKGROUND OF THE INVENTION

A lot of different spray drying processes and equipment therefore have been developed during the last many decades. A standard textbook on this technology is Masters, Keath: Spray Drying Handbook, 5th edition, Longman Scientific & Technical (1991), incorporated herein by reference.

It is conventional to select the spray dryer design and configuration and also the process parameters in consideration of the type of product to be dried and the desired characteristics of the final product, e.g. agglomeration, particle size, density etc.

Some of the issues hitherto considered in this respect are drying chamber design as to shape and dimensions; integration of a fluidized bed in the chamber bottom; integration of filters for separating product from the drying gas; selection of type of atomizer for the feed —rotary atomizer or nozzles, pressure nozzles or 2-fluid nozzles; type of gas disperser; drying gas temperature and velocity; feed-spray and gas flow directions; feed formulation and properties etc.

Other means for influencing product characteristics comprise separation of the total drying process into two or more steps in which the temperatures are controlled individually, recirculation of fine particles as well as control of several other parameters.

However, in spite of the fact that numerous measures are thus conventional for influencing product characteristics there is still room for improvements within certain areas of spray drying technology.

Thus, spray drying of some products involves creation of large vacuols in the droplets during drying thereof which results in blowing-up "balloon" particles, having thin walls which may break down before the drying process is terminated. Such breaking down of the particles results in a low-density and dusty product implying disadvantages in handling, transport and use, e.g. as pharmaceuticals.

Certain pharmaceuticals are preferably administered in formulations in which they are present in amorphous state. This is due, e.g. to the fact that the solubility rate for these pharmaceuticals is higher for the amorphous form than for crystalline forms thereof. Several modern pharmaceuticals have such low solubility rates in crystalline form that their bioavailability after administration is impeded thereby. Therefore, there is a need for preparing such pharmaceuticals with a structure wherein the amorphous state is more dominating than in the structure obtained by the conventional spray drying methods. The preference of pharmaceuticals in amorphous form is described inter alia in WO 98/57967 A, U.S. Pat. Nos. 5,612,367 and 5,641,745.

The amorphous form may be the preferred one in several forms of pharmaceutical preparations intended for various routes of administration.

The difficulties in obtaining a dominating amorphous structure when spray drying certain products are to some extent connected to the creation of thin-walled easily breaking particles since the surfaces exposed by breaking of said walls may initiate or accelerate crystallization processes.

Apart from the above described problems connected to the obtainment of a low-density product consisting to a large degree of fractured particle walls and the problems relating to the production of a powder having amorphous particle structure, it is a problem that in conventional spray drying processes the possibility for increasing the drying rate and, thus, the capacity of a certain apparatus without impairing heat economy and product quality is very limited.

SUMMARY OF THE INVENTION

It has now turned out that the above problems may be solved and further advantages obtained by conducting the spray drying in a pressurized atmosphere not below 1.25 bar absolute.

Thus, the invention deals with a method of spray drying a liquid medium comprising an evaporable liquid in which material is dispersed, able to form particles when said medium being spray dried, by atomizing said liquid medium as droplets into a drying chamber, maintaining in said chamber conditions causing evaporation of said evaporable liquid from said droplets to form particles containing said material, and recovering said particles from said chamber, which method is characterized in maintaining in the chamber a pressure not below 1.25 bar absolute. selected or experimentally determined pressure not below 1.25 bar absolute.

The liquid medium to be spray dried comprises an evaporable liquid in which a material to be recovered as powder is dispersed. The material may be dissolved in or suspended as solid particles in the evaporable liquid or it may be emulsified as droplets therein, provided that by the spray drying, possibly by the influence of adjuvants, it forms particles.

The actual pressure to be the most optimal for a certain drying process obviously depends on the material to be dried and the desired characteristics thereof and is selected within the range from 1.25 bar to the maximum pressure which the equipment is designed for. Said optimal value is either pre-selected on basis of previous experiences or is determined by simple initial experiments using the same equipment and materials as intended for the actual production.

Based on present experiences, it is assumed that the pressure shall preferably be from 1.5 to 75 bar, more preferably from 2 to 15 bar. For certain products, the pressure shall most preferably be from 5 to 15 bar, and for other products more preferably from 2 to 10 bar.

As to inter alia the bulk-density increasing aspect, the method according to the invention is characterized in that the pressure in the drying chamber is selected or determined to suppress or reduce formation of vacuols in the droplets, which vacuols could otherwise result in thin, easily breaking particle walls. Thereby a product of higher bulk-density and better flowability is obtained than if only atmospheric pressure had existed in the drying chamber and, consequently, a larger proportion of broken particle walls would be in the product.

Especially, when the solution or suspension to be spray dried comprises film-forming and/or binding materials, e.g. polymers added with the intended use of the spray dried material in pharmaceutical preparations, the problem caused by formation of vacuols in the drying droplets exists.

Examples of such film forming and/or binding additives comprise the following:

Film Forming Polymers (Both Water Soluble and Insoluble)
Cellulose derivatives
Acrylic polymers and copolymers
Vinyl polymers and other high molecular polymer derivatives
Synthetic Polymers
Methylcellulose
Hydroxypropylcellulose
Hydroxypropylmethylcellulose
Ethylcellulose
Cellulose acetate
Polyvinyl pyrrolidone
Polyvinyl pyrrolidone acetate
Polyvinyl acetate
Polyvinylmethacrylates
Ethylene-vinyl acetate copolymer
Materials for Improving the Properties of Film Forming Polymers Plasticizers
Phthalic acid esters
Triacetin
dibutylsebacate
Monoglycerides
Citric acid esters
Polyethyleneglycols
Anti Adhesives
Talc
Metal stearates
Diffusion—Accelerators
Diffusion—Retarders
Functional Coats that are pH Sensitive
Cellulose acetate timellitate (CAT)
Hydroxypropylmethyl cellulose phthalate (HPMCP)
Polyvinyl acetate phthalate (PVAP)
Cellulose acetate phthalate (CAP)
Hydroxypropyl methylcellulose acetate succinate (HPMCAS)
Carboxymethyl ethylcellulose (CMEC) Shellac
Other Functional Coating Materials
Methylmethacrylates or copolymers of methacrylic acid and methylmethacrylate
Eudragit polymers
Eudragits L, S, "L and S" and LD are anionic copolymers of methacrylic acid and methylmethacrylate.

A very important aspect of the invention is the production of amorphous materials. The method in this respect is characterized in that said material in the liquid to be spray dried comprises at least one component which at ambient temperature, possibly in the presence of one or more adjuvants present in said material, may exist in amorphous as well as in crystal-line form and the spray dried product comprises said substance in a state of higher amorphisity than if the spray drying had been performed using bulk-density and inferior powder characteristics as explained above. The substances may be of the same nature as those listed as film forming polymers above. By using the increased drying pressure according to the invention, the harmful influence of said adjuvants may be counteracted and, consequently, the adjuvants may be used in larger amount than otherwise acceptable. Thereby, the invention provides a supplementing measure of obtaining amorphous products. which would have occurred had the temperature been lower during said leaving of evaporable liquid and resulting increase of solute concentration in the droplets. The time period from the point where any precipitation of solid commences in the droplets until the total droplet solidifies, is short, leaving only room for little crystallization if any, and, furthermore, the viscosity of the liquid phase in this period is high which also counteracts crystallization.

Finally, the avoidance of broken and ruptured thin particle walls is expected to reduce or prevent subsequent creation and growth of crystals in the late stages of the drying process and the subsequent handling of the product.

According to the invention, the amorphisity of the dried substance can be further increased by adding to the solution or suspension to be spray dried, an adjuvant impeding the crystallization of the substance during drying, which adjuvant can be added in an amount in excess of the maximum amount acceptable if drying were performed using approximately atmospheric pressure in the drying chamber.

Adjuvants increasing the proportion of amorphous substance in the spray dried material are typically such which would increase the formation of vacuols in the droplets during drying and, thus, result in a low bulk-density and inferior powder characteristics as explained above. The substances may be of the same nature as those listed as film forming polymers above. By using the increased drying pressure according to the invention, the harmful influence of said adjuvants may be counteracted and, consequently, the adjuvants may be used in larger amounts than otherwise acceptable. Thereby, the invention provides a supplementing measure of obtaining amorphous products.

The invention permits the use of adjuvants in sufficient amounts to counteract any stickiness inherent in components of the product forming material. In spray drying at 1 bar absolute, the use of such adjuvants may be more restricted, as they may result in low bulk weight caused by hollow and broken particles.

Due to the fact that a higher pressure is maintained in the spray drying chamber and, thus, a larger weight of drying gas may be passed through said chamber at the same flow velocities as used when spray drying at approximately atmospheric pressure, the quantity of liquid dried in the chamber may also be increased. The rate of diffusion of the evaporized liquid into the drying gas is decreased by the pressure increase. However, it is in spite thereof possible to increase the capacity by increasing the pressure in the drying chamber.

Thus, an embodiment of the method according to the invention is characterized in that the quantity of solution or suspension atomized into the drying chamber is higher than the maximum quantity allowable if the drying were performed at approximately atmospheric pressure.

In a special aspect of the invention, the method is characterized in that the evaporable liquid is a fluid which would form a gas at atmospheric pressure and ambient temperature. In this embodiment, the drying chamber may not be a proper chamber, for which reason this term in the present specification and claims is used in the broadest sense. In this last-mentioned embodiment, the pressure may be substantially higher than indicated above and the adjustment of the pressure can be made, not only with the purpose of influencing particle structure but also particle size.

The invention furthermore comprises a plant for spray drying a solution or suspension of at least one solid in a evaporable liquid comprising:

a drying chamber designed for withstanding a pressure above the atmospheric;

an atomizing device for atomizing said liquid medium and for injecting the resulting droplets into said chamber;

means for introducing a drying gas at a pressure not below 1.25 bar absolute to contact the injected droplets; and means for withdrawing the particles formed by the drying and spent drying gas from the drying chamber.

Preferred embodiments of this plant are defined in the attached sub-claims 12–14 and explained in more details in connection with the drawings below.

In a further aspect, the invention deals with a particulate material produced by the above defined method and characterized in comprising at least one component of which at least a proportion has amorphous structure, said proportion being higher than if the material were obtained using spray drying of the same liquid starting medium at approximately atmospheric pressure. As explained above, a high degree of amorphisity may be desired, especially in the pharmaceutical industry.

Additionally, the invention deals with a particulate material obtained according to the method of the invention and being constituted to a large extent of particles having unbroken walls, which material has a bulk density higher than the one which would have been obtained if spray drying at approximately atmospheric pressure had been used for drying the same liquid starting medium. The particle properties, such as high bulk density, particle shape and flowability, obtainable according to the invention, are desired also inter alia in the ceramical industries and in metal powder sintering industries. Also for these purposes binders may form part of the particles.

The method and the plant according to the invention are further explained below with reference to the drawings.

BRIEF DESCRIPTION OF THE DRAWINGS

Referring to FIG. 1, gas, such as air, is led through a conduit 1 to a compressor 2 to achieve a pressure above 1.25 bar absolute. The exact pressure of the gas leaving the compressor is adjusted by means of a pressure control device, such as a valve 3, and the gas is subsequently passed through a heater 4, before being introduced into a gas disperser 5 above a spray drying chamber 6.

Figure 1:
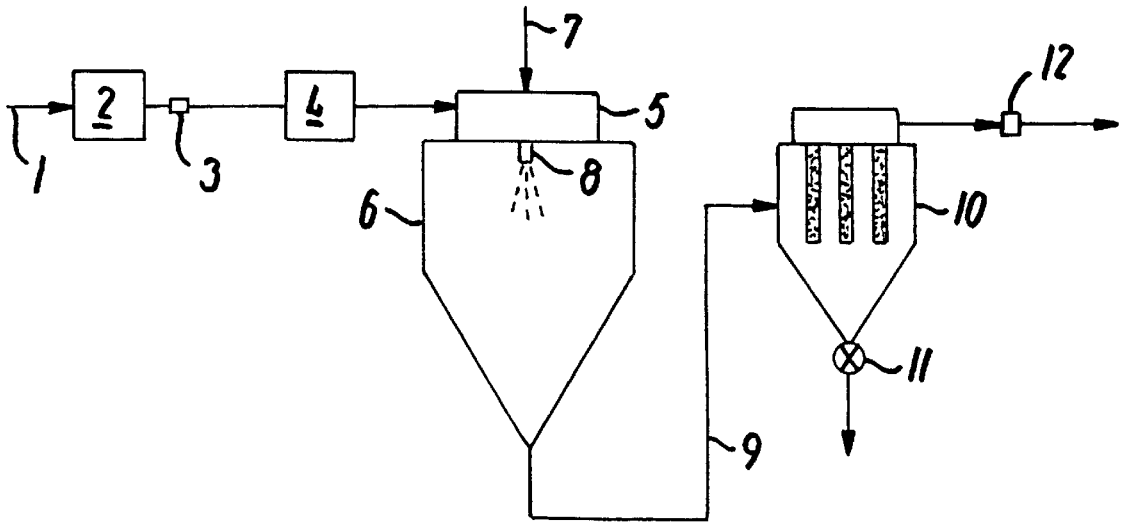
FIG. 1. shows schematically a layout for an embodiment of a plant according to the invention, FIG. 2. shows schematically another embodiment of a plant according to the invention, FIG. 3. illustrates a further embodiment of the plant according to the invention, wherein the drying gas is conducted in closed cycle.

On the drawing, the chamber 6 is shown as a conventional chamber having a cylindrical and a conical portion, but any of the various embodiments for drying chambers hitherto suggested for spray drying can be utilized.

Through a conduit 7, the liquid medium to be spray dried is introduced to an atomizing device 8 which may be of any conventional design, e.g. a rotary atomizer wheel, a pressurized nozzle or a 2-fluid nozzle.

The particulate material formed by the spray drying leaves the drying chamber 6 entrained in spent drying gas through conduit 9, leading to a particle separator which in the depicted embodiment is a baghouse 10. Alternatively or supplementary, a cyclone may be used.

From the bottom portion of 10, the collected particles are removed through an airtight sluice or valve 11.

The spent drying gas having passed the filter is led to a pressure controlling device, e.g. a valve 12, from where the gas leaves for further processing or disposal.

The two pressure controlling devices 3 and 12 ensure maintenance of the super atmospheric pressure in the drying chamber 6 as required according to the invention. Said pressure controlling devices are preferably automatically regulated by means of computer aided equipment (not shown).

Figure 2:
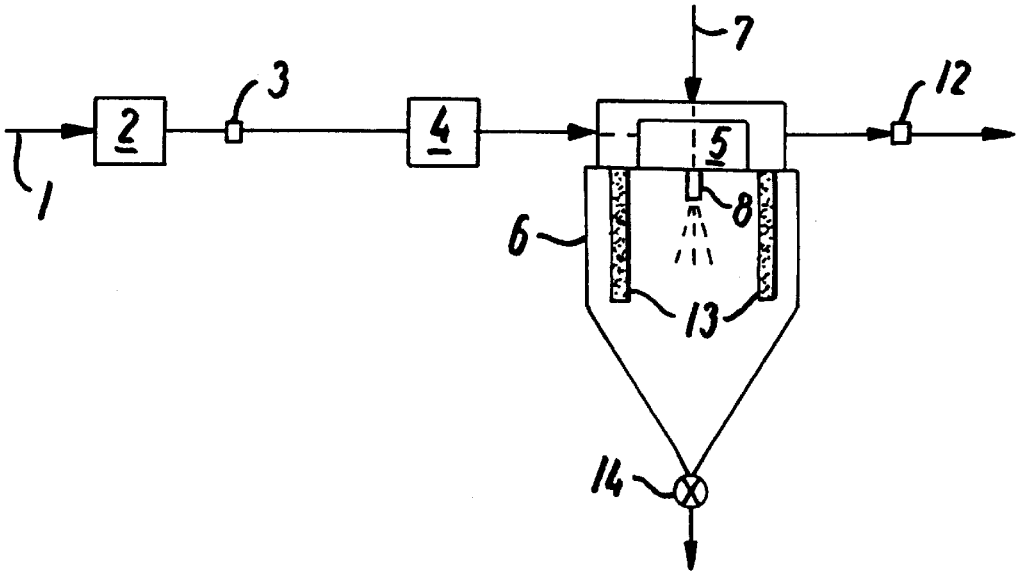

The embodiment depicted in FIG. 2, is rather similar to the one described in connection with FIG. 1, apart from the fact that the external particle separator 10 is replaced by filter members 13 integrated in the drying chamber 6. The particles which collect on the surfaces of the filter members 13 are by vibration or by means of counterdirected pressurized air liberated from said surfaces and fail to the bottom of the chamber 6 from where they are recovered through a sluice or valve 14.

The remaining reference numbers have the same significance as explained in connection with FIG. 1.

Figure 3:
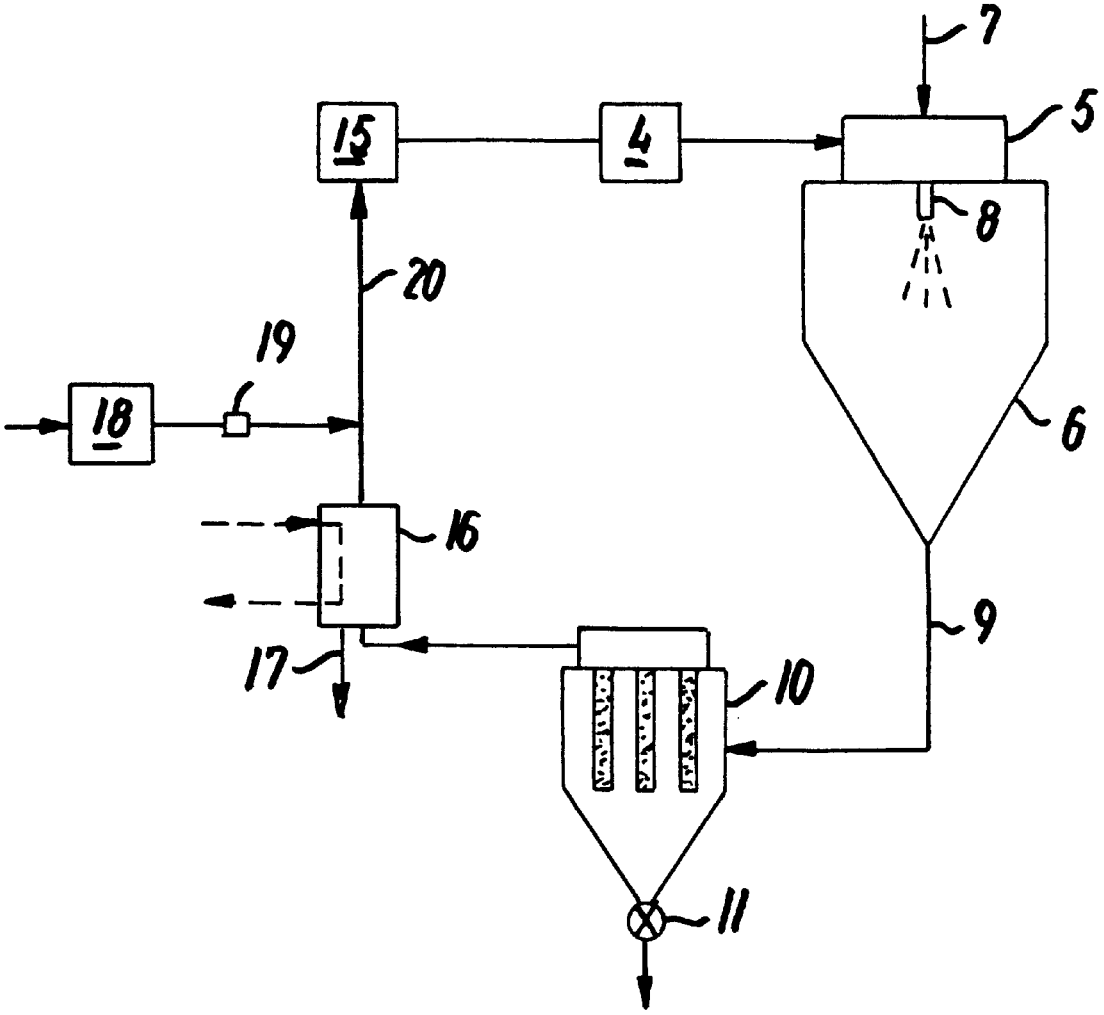

In the embodiment depicted in FIG. 3, the drying gas is conducted in a closed circuit. A blower 15 provides the necessary circulation in the system. From said blower 15, a stream of gas is passed through the heater 4 to the gas disperser 5. The reference numbers 6–11, have the same significance as explained in connection with FIG. 1.

In this closed cycle system, where the evaporable liquid in the medium introduced through 7 is recovered, said liquid will often be an organic solvent. When pharmaceutical products are handled, such solvents will typically be alcohols, e.g. methyl, ethyl and isopropyl alcohol, ketones, e.g. acetone, or halogenated hydro-carbons, e.g. trichloromethane and methylene dichloride.

When leaving the particle separating unit 10, the spent drying gas is conducted through a condenser 16 through which also a cooling medium is cycled as indicated by the dotted line. The evaporable liquid which condenses in 16 is recovered through 17 for re-use.

To maintain the pressure in the circuit at the desired level above 1.25 bar absolute, a compressor 18 introduces drying gas through a pressure control device 19 into a conduit 20 conducting drying gas from the condenser 16 to the blower 15. The pressure control device 19 is also in this embodiment preferably regulated by a computer aided control system.

This closed cycle system not only enables recovering of the liquid evaporated in the drying chamber 6 but enables also operating of the process at relatively high pressures with only moderate energy consumption, since the function of the compressor 18 is just to replace gas leaked out from the system, e.g. in connection with the recovering of the particulate product.

Figure 4:
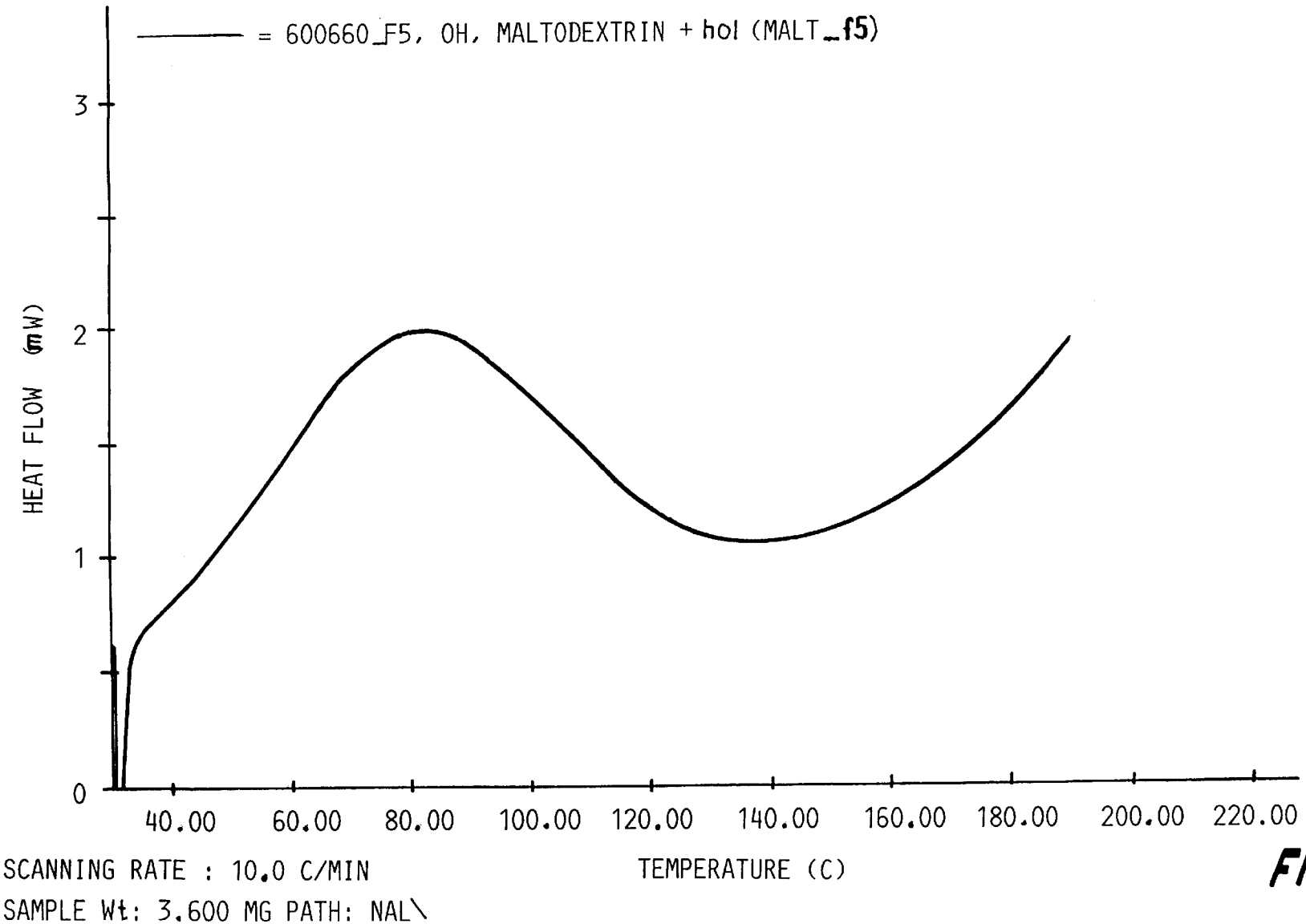
FIG. 4. is a calorimetric graph for determining crystallinity in a specimen produced according to the invention, FIG. 5. is a calorimetric graph for determining crystallinity in a specimen corresponding to the one used in the determinations forming basis for FIG. 4 but dried at atmospheric pressure, and FIG. 6. is a graph illustrating the increased bulk-density obtained by the process according to the invention in comparison to conventionally dried products.
Figure 5:
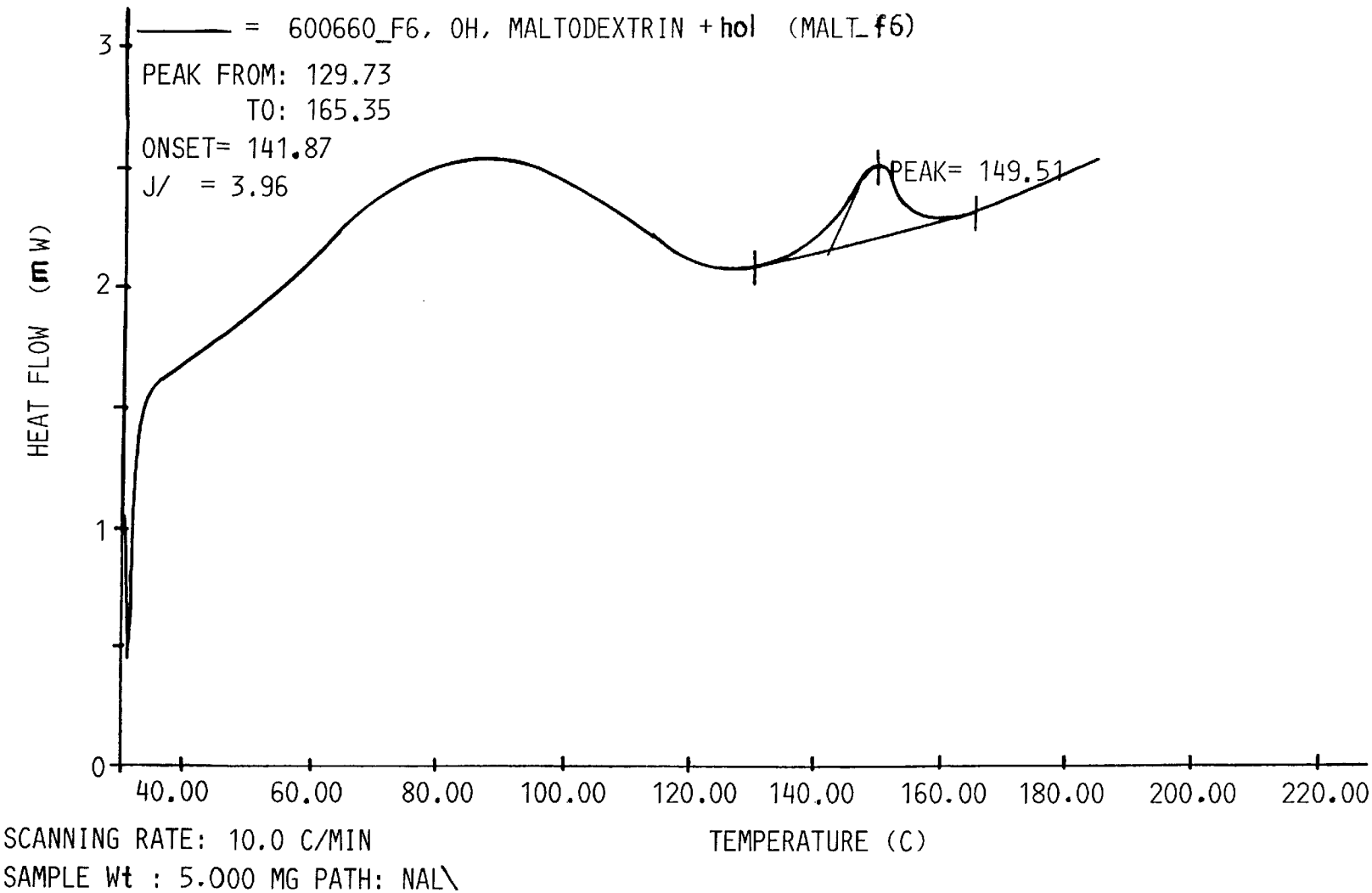

The calorimetric graphs shown in FIGS. 4 and 5 relate to product samples produced from the same starting liquid medium in the same equipment but using different drying pressures. The liquid medium had been prepared by mixing 5% by weight paracetamol, 70% by weight maltodextrin 19-15 (Cerestar) and 25% by weight hydroxyethylcellulose and dissolving the mixture in water to obtain a medium containing 6.67% by weight total solids.

The samples had been produced by means of a plant as the one shown in FIG. 2 by drying said medium using an inlet drying gas temperature of 145° C. and a drying gas outlet temperature of 105° C.

The graphs show the relation between temperature increase and heat flow.

The presence of crystalline substance in the samples will be reflected in the graphs by a peak indicating an increase of the heat flow due to the heat consumption for melting the crystals.

FIG. 4 relating to the sample dried at 2 bar absolute has no peak due to lack of crystalline material and it can thus be concluded that the paracetamol therein is present in amorphous state.

In contrast thereto, FIG. 5 shows a peak at 149.51° C. which, when compared to reference analysis on pure paracetamol, indicates that only 55% of the paracetamol is present in amorphous state.

Microscopic examination of the two spray dried products confirmed that whereas crystals were present in the product dried at 1 bar, they were absent in the product dried according to the invention.

Thus, an increase of the drying chamber pressure to 2 bar absolute has a very significant and dramatic effect on the structure of the resulting product.

Figure 6:
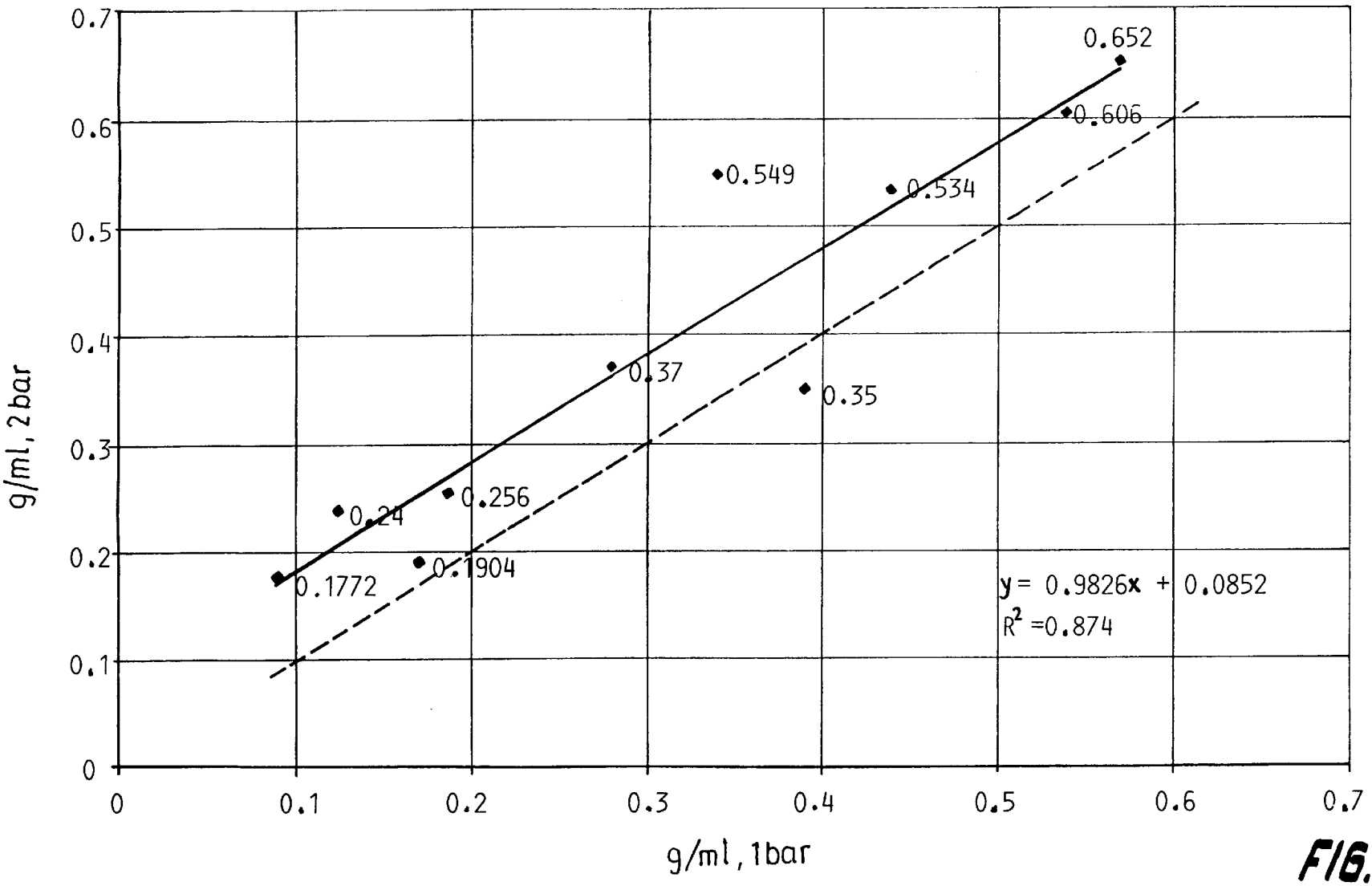

The chart forming FIG. 6 is based on bulk-density determinations and samples of varying densities and containing substances selected from the group consisting of paracetamol, maltodextrin, hydroxyethylcellulose, hydroxymethylpropylcellulose and mixtures thereof.

As it appears from the chart, the bulk-density of the products spray dried at 2 bar is higher than when spray drying is performed at 1 bar and this holds true for the broad range of bulk-densities covered by the tests.

If the bulk-densities had been independent of the spray drying pressure, the graph would have been as indicated by the dotted line. The distance between the two, almost parallel lines reflects the bulk-density increasing effect of the method according to the invention.

To further elucidate the invention, reference is made to the following non-limiting examples.

EXAMPLES

The below tests were performed using equipment similar to the one illustrated in FIG. 2, i.e. The drying chamber was provided with integrated filter. The atomizer was a 2-fluid nozzle. In each test, the spray dryer was operated for 1–1½ h.

Test 1 and 2

A maltodextrin type 19-15 from Cerestar was dissolved/suspended to produce an aqueous feed of 20% dry solids. In Test 1, an amount was spray dried at 1 bar absolute chamber pressure. In Test 2, an amount was spray dried at 2 bar absolute chamber pressure.

The pressure of the atomizing gas used in the 2-fluid nozzle was 3 bar absolute.

The results were as follows:

| Test | No. 1 | No. 2 |
|---|---|---|
| Chamber pressure, bar absolute | 1 | 2 |
| Density - loose, g/ml | 0.329 | 0.466 |
| Density - tapped × 200, g/ml | 0.569 | 0.652 |

The product used in the above tests does not have any distinct "balooning-effect". Nevertheless, the product bulk-density obtained at 2 bar absolute chamber pressure is about 15% higher than the bulk-density of 25 the product produced at 1 bar absolute chamber pressure.

Tests 3 and 4

A maltodextrin type 19-15, Cerestar, was dissolved/suspended to produce an aqueous feed containing 20% dry solids. To said feed, 8% hydroxypropylmethylcellulose was added.

In Test 3, an amount of this feed was spray dried at 1 bar absolute chamber pressure, whereas Test 4 was performed using 2 bar absolute chamber pressure.

Also in these test, the atomizing gas used in the 2-fluid nozzle was at 3 bar absolute.

The following results were obtained:

| Test | No. 3 | No. 4 |
|---|---|---|
| Chamber pressure, bar absolute | 1 | 2 |
| Density - loose, g/ml | 0.298 | 0.456 |
| Density - tapped × 200, g/ml | 0.340 | 5.549 |
| Particle density, g/ml | 1.213 | 1.252 |
| Interstital air, ml/100 g | 211.677 | 102.245 |
| Occluded air, ml/100g | 17.924 | 15.388 |
| 10% < d, micrometer | 6.95 | 10.73 |
| 50% < d, micrometer | 12.61 | 22.61 |
| 90% < d, micrometer | 21.33 | 45.34 |

In these tests, where the feed was added a binder, as is often the case in practical drying processes, the "balloon-effect" is more distinct, and it thus appears that the product bulk-density at 2 bar absolute chamber pressure is about 61% higher than the bulk-density of the product produced at 1 bar absolute chamber pressure.

The above tests prove that the bulk-density improving effect of the method according to the invention is significant and pronounced, especially when the liquid to be spray dried contains components having a tendency of forming balloon-like particles in the drying process.

What is claimed is:

1. A method of spray drying a liquid medium comprising an evaporable liquid in which material is dispersed, able to form particles when said medium being spray dried, by atomizing said liquid medium as droplets into a drying chamber, maintaining in said chamber conditions causing evaporation of said evaporable liquid from said droplets to form particles containing said material, and recovering said particles from said chamber, characterized in maintaining in the chamber a pressure not below 1.25 bar absolute.

2. A method according to claim 1, characterized in that said pressure is from 1.5 to 75 bar.

3. A method according to claim 1, characterized in that said pressure is from 2 to 15 bar.

4. A method according to claim 1, characterized in that said pressure is from 5 to 15 bar.

5. A method according to claim 1, characterized in that said pressure is from 2 to 10 bar.

6. A method according to claim 1, characterized in that the pressure in the drying chamber is selected to suppress formation of vacuoles in the droplets, which would result in thin, easily breaking particle walls, thereby obtaining a product of higher bulk density and better flowability than if approximately atmospheric pressure had existed in the drying chamber.

7. A method according to claim 1, characterized in that said material comprises at least one component, which at ambient temperature may exist in amorphous as well as in crystalline form and wherein the spray dried product comprises said at least one component in a state of higher amorphisity than if the spray drying had been performed using approximately atmospheric pressure in the drying chamber.

8. A method according to claim 7, characterized in that the amorphisity of said substance is further increased by adding to the liquid medium to be spray dried, an adjuvant impeding the crystallization of said component during drying, which adjuvant is added in an amount in excess of the maximum amount acceptable if drying were performed using approximately atmospheric pressure in the drying chamber.

9. A method according to claim 1, characterized in that the quantity of liquid medium atomized into the drying chamber is higher than the maximum quantity that would be atomized if the drying were performed at approximately atmospheric pressure.

10. A method according to claim 1, characterized in that said evaporable liquid is a fluid which would form a gas at atmospheric pressure and ambient temperature.

11. A particulate material produced by the method of claim 1, characterized in comprising at least one component of which at least a proportion has amorphous structure, said proportion being higher than if the material were obtained using spray drying of the same liquid starting medium at approximately atmospheric pressure.

12. A particulate material according to claim 11, characterized in being a pharmaceutical product.

13. A particulate material obtained according to the method of claim 1 and being constituted to a large extent of particles having unbroken walls, which material has a bulk density higher than the one which would have been obtained if spray drying had been used for drying the same liquid starting medium at approximately atmospheric pressure.

* * * * *